US012799698B2

(12) United States Patent
Macovei-Benczur

(10) Patent No.: US 12,799,698 B2
(45) Date of Patent: Nov. 17, 2026

(54) METHOD FOR THE INJECTION OF INJECTION MATERIAL FOR THE UPLIFT OF A SURFACE AREA

(71) Applicant: Sebastian Vasile Macovei-Benczur, Edmonton (CA)

(72) Inventor: Sebastian Vasile Macovei-Benczur, Edmonton (CA)

(73) Assignee: Sebastian Vasile Macovei-Benczur

( * ) Notice: Subject to any disclaimer, the term of this patent is extended or adjusted under 35 U.S.C. 154(b) by 202 days.

(21) Appl. No.: 18/511,127

(22) Filed: Nov. 16, 2023

(65) Prior Publication Data

US 2025/0163663 A1 May 22, 2025

(51) Int. Cl.

| | |
|---|---|
| ***E02B 3/00*** | (2006.01) |
| ***E02D 3/00*** | (2006.01) |
| ***E21B 7/04*** | (2006.01) |

(52) U.S. Cl.

CPC ..... *E02D 3/00* (2013.01); *E21B 7/046* (2013.01); *E02D 2250/003* (2013.01); *E02D 2300/0037* (2013.01); *E02D 2300/0079* (2013.01)

(58) Field of Classification Search

CPC ..... E02D 3/00; E02D 3/12; E02D 2250/003; E02D 2300/0037; E02D 2300/0079; E21B 7/046

See application file for complete search history.

(56) References Cited

U.S. PATENT DOCUMENTS

| | | | | |
|---|---|---|---|---|
| 3,850,247 | A | 11/1974 | Tinsley | |
| 4,119,150 | A | 10/1978 | Froelich | |
| 4,489,526 | A | 12/1984 | Cummins | |
| 5,589,603 | A | 12/1996 | Alexander et al. | |
| 6,002,063 | A | 12/1999 | Bilak et al. | |
| 6,363,685 | B1 | 4/2002 | Kugler | |
| 7,850,398 | B2 | 12/2010 | Foo et al. | |
| 2002/0009331 | A1 * | 1/2002 | Carter, Jr. | E02D 31/00 405/129.55 |
| 2010/0186952 | A1 | 7/2010 | Heisel et al. | |
| 2013/0180722 | A1 | 7/2013 | Caro et al. | |
| 2014/0262232 | A1 * | 9/2014 | Dusterhoft | E21B 47/06 166/250.1 |

(Continued)

FOREIGN PATENT DOCUMENTS

| | | | | |
|---|---|---|---|---|
| WO | WO-2019114998 A1 * | 6/2019 | | E02D 3/12 |

*Primary Examiner* — Kyle Armstrong

(74) *Attorney, Agent, or Firm* — Daniel Enea; Jordan Sworen; Argus Intellectual Enterprises, LLC

(57) ABSTRACT

A method for the injection of injection material for the uplift of a surface area. The method includes selecting a target subterranean depth/stratum for depositing the injection material and preparing a wellbore extending from the ground surface to the target subterranean depth/stratum via utilization of a drill string. A directional drill is used for creating a horizontal wellbore, wherein a lifting routine is performed upon detection of the position of the directional drill. The lifting routine includes injecting a slurry comprising materials suspended in a carrier liquid into the injection well, lifting the surface area to a target lift elevation by depositing the injection material to the subterranean depth/stratum, resulting in an uplifting force, and measuring the rise in elevation of the surface area via surface indicators. The method achieves precise and non-disruptive elevation modification of surface areas to target levels.

20 Claims, 2 Drawing Sheets

(56) References Cited

U.S. PATENT DOCUMENTS

| | | | | |
|---|---|---|---|---|
| 2015/0275644 | A1 | 10/2015 | Chen et al. | |
| 2018/0016765 | A1* | 1/2018 | Baldwin | E02D 37/00 |
| 2019/0186095 | A1* | 6/2019 | Eddie | G01N 33/24 |
| 2022/0169917 | A1* | 6/2022 | Allen, III | C09K 8/90 |

* cited by examiner

METHOD FOR THE INJECTION OF INJECTION MATERIAL FOR THE UPLIFT OF A SURFACE AREA

BACKGROUND OF THE INVENTION

The present invention relates to a method for the injection of injection material for the uplift of a surface area. More specifically, the method comprises an injection of injection material into a subterranean stratum to cause an uplift at the target area. A target subterranean depth or stratum where the injection materials will be deposited is selected. A wellbore is then prepared, extending from the ground surface to the specified subterranean depth or stratum using a drill string, with a directional drill employed to create a horizontal wellbore. A lifting routine is executed that includes the injection of a slurry comprising materials suspended in a carrier liquid into the wellbore. By progressively depositing these injection materials into the subterranean stratum, the surface area is uplifted to a predetermined elevation, generating an uplifting force. The elevation change is measured through the use of surface indicators, ensuring accuracy and control throughout the process.

Coastal regions are particularly vulnerable to the devastating impact of hurricanes, as they often face the dual threats of torrential rains and storm surges. The catastrophic events like Hurricane Katrina, which struck the Gulf Coast of the United States in 2005, serve as stark reminders of the havoc that extreme weather phenomena can unleash upon coastal communities. The aftermath of this disaster and other natural disasters exposed the limitations of traditional flood mitigation strategies and the urgent need for innovative, long-term solutions. Coastal areas that are prone to such natural disasters require proactive measures to ensure the safety of inhabitants and the preservation of essential infrastructure. In regions like the southern east coast of the United States, where hurricanes are a recurrent threat, they require tools to mitigate hurricane-related damage, reduce risks to human life, and safeguard the well-being of coastal communities.

In areas prone to flooding, traditional approaches for flood risk mitigation typically involve the construction of dikes, sea walls, and other water-retaining structures. However, such solutions have several inherent disadvantages. Firstly, built structures carry a quantifiable risk of failure, and their presence may not always be acceptable, especially in environmentally sensitive or densely populated regions. Over time, these structures experience decreasing reliability, and they require periodic maintenance and replacement, resulting in a life-cycle issue.

Traditional flood mitigation methods based on built structures not only pose a risk of failure but also disrupt the natural landscape, often altering the real estate value of the affected areas. Additionally, constructing and maintaining these structures can be costly and may encounter public resistance due to their impact on the environment and aesthetics. The finite lifespan of such structures further compounds the challenges of long-term flood risk management.

In view of these developments, there exists a need for a method to uplift the surface area without surface infrastructure disruption, and the long-term reliability of geological-scale jacking. The method minimizes or eliminates the need for the construction of dikes, sea walls, or similar structures, thus avoiding the drawbacks associated with such conventional solutions.

The present invention addresses these challenges by introducing a new approach to surface elevation increase that is minimally disruptive to existing structures and stable across the stratum. This method utilizes some existing oil drilling technology, such as directional drilling techniques commonly employed for hydraulic fracturing (fracking), to access a targeted geological structure for the injection of solid materials carried by a liquid. Unlike conventional flood protection methods, this innovative technology raises the surface elevation without disturbing existing buildings and infrastructure. The process involves drilling injection pipes directionally beneath the targeted area and injecting granular solid materials carried by a fluid into the strata until the desired elevation is reached. The fluid can be drained or left in place, depending on the strata's capacity.

By raising the surface elevation above flood risk levels, this novel method offers a promising alternative to traditional flood mitigation strategies, making it well-suited for application in low-lying regions susceptible to flooding, such as the Netherlands, lower mainland British Columbia, the southern east coast of the United States, and other flood-prone areas worldwide.

In light of the devices disclosed in the known art, it is submitted that the present invention substantially diverges in design elements and methods from the known art and consequently it is clear that there is a need in the art for an improvement for a method for the injection of injection material for the uplift of a surface area. In this regard the instant invention substantially fulfills these needs.

SUMMARY OF THE INVENTION

In view of the foregoing disadvantages inherent in the known types of flood protection and surface elevation enhancement methods, including those reliant on dikes, sea walls, and other disruptive solutions, the present invention provides a method for the injection of injection material for the uplift of a surface area.

It is an objective of the present invention to provide an embodiment of the method for the injection of injection material to uplift a surface area. This method involves selecting a target subterranean depth/stratum for depositing the injection material, preparing a wellbore from the ground surface to the target subterranean depth/stratum utilizing a drill string, utilizing a directional drill for creating a horizontal wellbore, detecting the directional drill's position, performing a lifting routine, which includes injecting a slurry comprising materials suspended in a carrier liquid into the injection well, thus lifting the surface area to a target lift elevation by depositing the injection material to the subterranean depth/stratum, and measuring the rise in elevation of the surface area via surface indicators.

It is yet another objective of the present invention to provide an embodiment of the method to provide a controlled and environmentally friendly solution for modifying surface elevation on a geological scale. The method creates vertical movements without significant horizontal displacements, making it suitable for raising elevation in large areas, such as flood zones.

It is yet another objective of the present invention to provide an embodiment of the method to preserve the structural integrity of existing buildings and infrastructure while offering a scalable approach to elevation modification.

It is therefore an object of the present invention to provide a new and improved method of lifting the surface area by depositing injection material to a target stratum that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
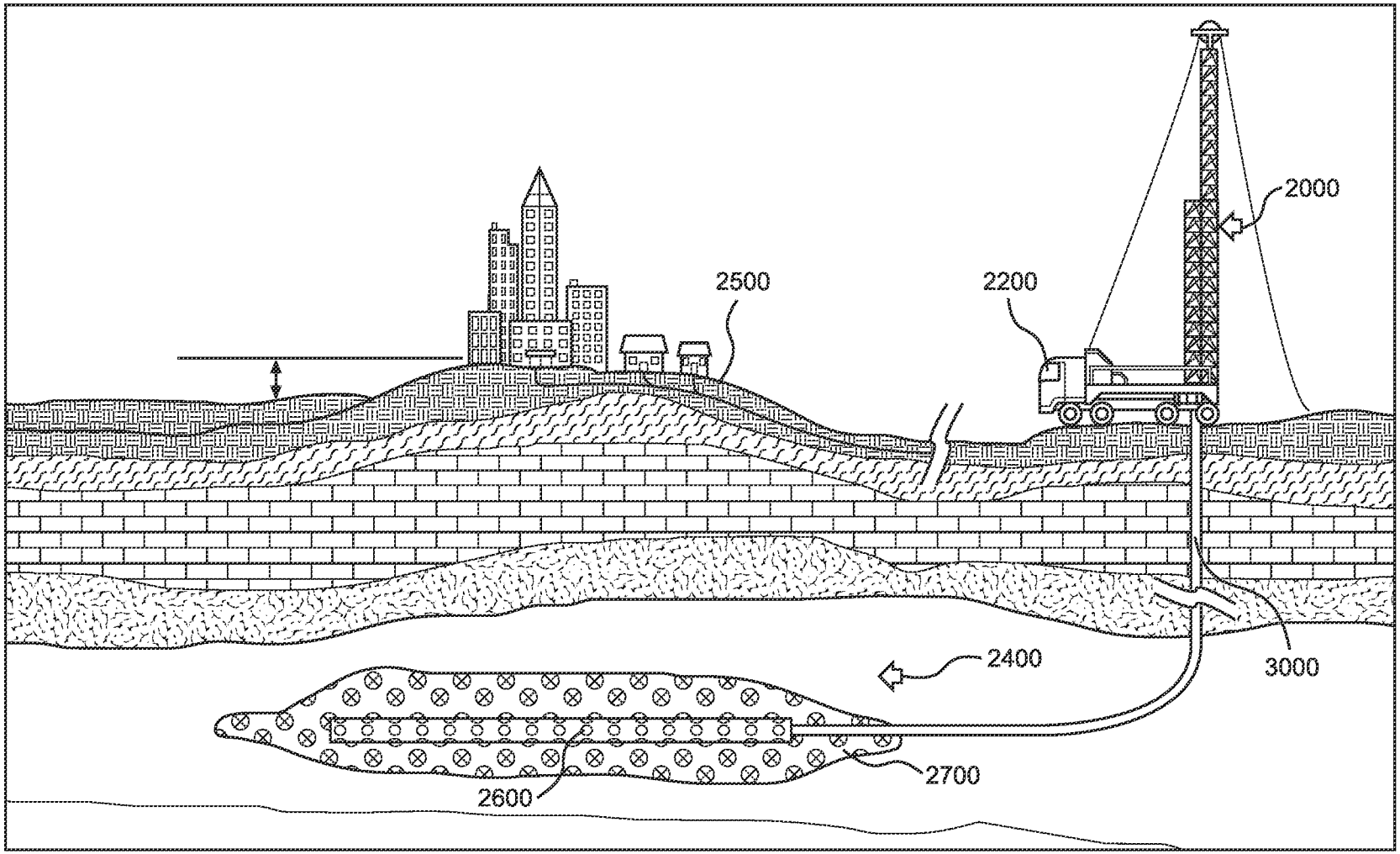
FIG. 1 shows a cross-sectional schematic view of a surface with drilling and injection equipment and an underground with a wellbore and a directional drill in a target stratum.

Reference is made herein to the attached drawings. Like reference numerals are used throughout the drawings to depict like or similar elements of the system. For the purpose of presenting a brief and clear description of the present invention, the embodiment discussed will be used for the injection of injection material to uplift a surface area. The figures are intended for representative purposes only and should not be considered to be limiting in any respect. Furthermore, the described features, structures, or characteristics may be combined in any suitable manner in one or more embodiments. In the following description, numerous specific details are provided to give a thorough understanding of embodiments.

Reference will now be made in detail to the exemplary embodiment(s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment," "first embodiment", "second embodiment", or "third embodiment" does not necessarily refer to the same embodiment.

Referring now to FIG. 1, there is shown a cross-sectional schematic view of a surface with drilling and injection equipment and an underground with a wellbore and a directional drill in a target stratum. In one method of the present invention, the method for the injection of injection material for the uplift of a surface area provides a solution to uplift the ground. The method utilizes some drilling tools (i.e., drill strings) and techniques (i.e., directional drilling) to pump an injection material 2700 (i.e., slurry or mud) in low-lying coastal regions prone to hurricane-induced surge. The injection of the injection material to a target stratum, provided the proper injection material and target stratum are selected, causes the surface to uplift.

In the shown embodiment, a drill string 2000 is positioned within a wellbore 3000 and drilled to a desired depth. In one embodiment, the wellbore is formed by the drill string 2000, wherein the drill string 2000 comprises a plurality of interconnected drill pipes and other components that are used to create a well bore during drilling operations. A pump truck 2200 includes or is otherwise in operation with an injection control system. The injection control system injects fluid into the subterranean region through the wellbore 3000. The shown well 3000 comprises a substantially full-length concrete production casing and a cemented surface casing. In some embodiments, the well 3000 is similar to a conventional oil well. During drilling, a high rate of mud circulation is employed. A low shrinkage, pliable and expandable cement is used for cementing the well, in order that the repeated and sequential applications of pressure during the lifting routine does not fracture or crack the concrete layer.

The method comprises the injection of fine materials into a targeted subterranean stratum 2400 to uplift a surface area 2500, ultimately raising it to a predetermined elevation that mitigates flood risks. Initially, a specific subterranean depth or stratum within the Earth's crust is tested to determine the geological profile and a target stratum is strategically chosen based on those geological characteristics. This ensures optimal suitability for the injection of materials that will subsequently raise the surface elevation. These geological characteristics include, but are not limited to, the permeability of the stratum, the composition of the stratum, the depth, the stability, and the compatibility with the slurry.

In one embodiment of the method, when the target stratum is reached directional drilling equipment 2600 is employed to control the path of the wellbore, allowing for horizontal drilling. Directional drilling is adapted to precisely position the wellbore in the stratum within a certain radius from the wellbore without requiring additional wellbores to be drilled.

In one embodiment, an open-bottom injection tubing string is lowered into the wellbore. During installation of the tubing string, a hole-bottom electronic pressure gauge is installed to measure pressure of the fluid within the tubing near the bottom of the hole. The gauge is employed to measure fluid pressure of the slurry during and after the injection. In one embodiment, the injection material is deposited at a pressure and flow rate determined based on the geological characteristics of the stratum and the desired lift elevation. In another embodiment, there exists a relationship between the flow rate and applied pressure of the slurry throughout the injection process. Typically, the flow rate is inversely proportional to the applied pressure. In scenarios where a higher burden, such as a greater depth or tougher strata requiring fracturing, is encountered, a higher pressure may be necessary to produce the desired lift. Conversely, in more porous or previously fractured formations, a lower pressure with a larger flow rate may be applied. The specific pressure and flow rate are determined in each individual case. This flexibility ensures that the method be tailored to diverse geological conditions, optimizing its effectiveness across a range of scenarios.

The slurry may be formed either in advance and trucked to the site in the pumping truck or prepared on site. The composition and density of the slurry is monitored to ensure that it meets desired specifications. Prior to slurry injection, tests may be run to assess the formation flow behavior (formation permeability and transmissivity) and the formation geomechanical behavior (compressibility, fracture behavior, stress state). In one embodiment, the method further comprises determining the appropriate type and concentration of materials in the slurry based on the geological characteristics of the target subterranean depth/stratum, wherein the target subterranean depth/stratum is configured to retain the solids of the slurry.

In one embodiment, the slurry is injected into the well in a series of one or more injection lifting routines/processes/episodes of between about 3-10 hours each. The injection pressure of the slurry is sufficient to overcome the parting pressure of the formation, whereby the suspended solid particles of the slurry remain in or adjacent to the target stratum. In one embodiment, the slurry forms a new stratum. The individual lifting episodes are separated by periods of between 10 and 100 hours depending on the response of the stratum. The injection well and the region surrounding the well are monitored by means of surface and subsurface techniques to optimize injectivity and to track formation response to the injected slurry. In one embodiment, the method comprises performing a second lifting routine after an initial settlement of the surface area. The second episode may occur in the same or different target stratum.

In one embodiment, several monitoring tools are used in addition to surface deformation measurement to assess the response to the injection. The surface uplift data allow discrimination between vertical and horizontal fracture orientations by virtue of the magnitude and direction of the tilt vectors from an array of tiltmeters positioned around the injection well and the surface. This indicates whether vertical or horizontal material transport away from the wellbore may be occurring. In one embodiment, the method comprises detecting the deformation of the surface in real time. The slurry is selected for uplift and stability, and may comprises fine material, gypsum and/or clay. The fine materials used may vary from clay, to sand or other type of material in a small granular form that will remain suspended in the slurry while maintained in a turbulent flow condition. In one embodiment, the surface indicators may comprise at least one of global positioning system (GPS) data, laser distance measurements, or tilt sensors.

In one embodiment, there is no horizontal movement of the surface area resulting from the lifting routine. The surface infrastructure is not structurally disturbed by the lifting of the surface area. The uplifting of the surface area is performed without causing damage to existing surface infrastructure, such as roads, buildings, or utilities. In one embodiment, the method utilizes a control system to adjust the injection material's deposition rate based on real-time data from the surface indicators.

Figure 2:
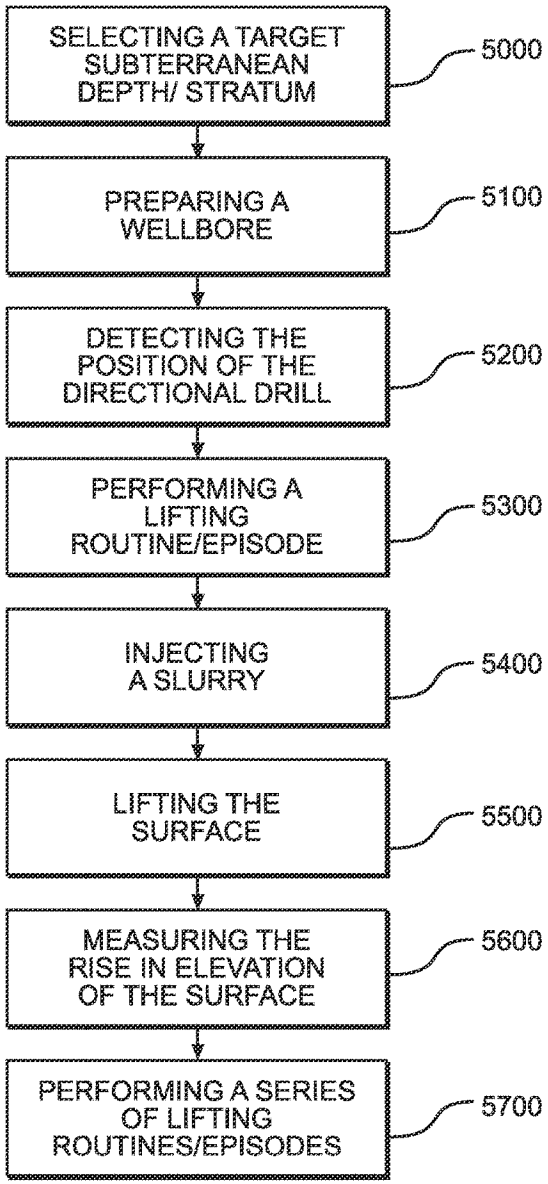
FIG. 2 shows a flow chart of an embodiment of the method for the injection of injection material to uplift a surface area.

Referring now to FIG. 2, there is shown a flow chart of an embodiment of the method for the injection of injection material to uplift a surface area. In the shown embodiment, there is shown a series of steps of the method used to uplift the surface area. Initially, an area that may benefit from uplift is identified by factors such as flood risk mitigation or elevation enhancement and selected 5000. After one or more locations are selected as possible areas to that are desirable to uplift, testing begins to select a target subterranean depth/stratum for depositing the injection material. The geological characteristics and analysis identify the most suitable stratum for receiving the injection material.

Once the target stratum is identified, the wellbore is prepared 5100. In some embodiments, a new wellbore is drilled which extends from the ground surface to the chosen subterranean depth or stratum. A drill string is used to achieve this and the employment of directional drilling tools to ensure precise wellbore alignment. In other embodiments, a wellbore is already drilled. The wellbore may need treatment or other structures to ensure structural integrity. In one embodiment, as the wellbore is being prepared, the position of the directional drill is monitored in real time. The real-time data gathering ensures the accurate alignment of the wellbore with the target subterranean depth or stratum 5200.

In the shown embodiment, lifting routine is executed to lift the target area 5300. A slurry composed of materials suspended in a carrier liquid is introduced into the wellbore 5400, ultimately reaching the target subterranean depth or stratum. The selection of slurry materials and the precise composition of the slurry are selected based on the specific characteristics of each uplift. The target surface area is lifted 5500 by the injection into the subterranean depth or stratum results in the generation of an uplifting force. This force effectively raises the surface area to the predetermined target elevation. Throughout the lifting routine, the drilling operation is continuously monitored 5600. This includes monitoring both surface and subsurface techniques, which are vital for keeping a close watch on the injection well and the region surrounding it. This monitoring includes the measurement of pressure, the assessment of formation response to the injected materials, and the real-time collection of data. Surface indicators play a vital role in this phase, constantly measuring the rise in elevation of the surface area.

In the shown embodiment, the injection process is divided into a series of one or more lifting routines or episodes 5700. The precise duration of these intervals is contingent on the observed response of the stratum.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method for the injection of injection material for the uplift of a surface area, the method comprising:

selecting a target subterranean depth/stratum for depositing the injection material;

preparing a wellbore extending from the ground surface to the target subterranean depth/stratum via utilization of a drill string;

wherein a directional drill is used for creating a horizontal wellbore within the target subterranean depth/stratum;

detecting the position of the directional drill;

performing a lifting routine, the lifting routine comprising:

injecting a slurry comprising materials suspended in a carrier liquid into the injection well;

lifting the surface area to a target lift elevation by depositing the injection material to the target subterranean depth/stratum resulting in an uplifting force;

measuring the rise in elevation of the surface area via surface indicators;

wherein the surface indicators are distributed across the surface area and generate real time surface deformation data during the lifting routine;

wherein the lifting routine is controlled based on the real time surface deformation data to raise the surface area to the target lift elevation while reducing differential displacement across the surface area.

2. The method of claim 1, wherein the surface area includes existing surface infrastructure comprising one or more of roads, buildings, or utilities, and wherein the lifting routine raises the surface area with a gradual elevation gradient while reducing horizontal displacement of the existing surface infrastructure.

3. The method of claim 1, wherein the lifting routine raises the surface area without structurally disturbing existing surface infrastructure disposed on the surface area.

4. The method of claim 1, wherein the uplifting of the surface area is performed without causing damage to existing surface infrastructure, wherein the existing surface infrastructure comprises one or more of roads, buildings, or utilities.

5. The method of claim 1, further comprising determining the desired type and concentration of materials in the slurry based on the geological characteristics of the target subterranean depth/stratum, wherein the geological characteristics comprise at least one of permeability, composition, depth, stability, or compatibility with the slurry.

6. The method of claim 1, wherein the target subterranean depth/stratum is configured to retain the solids of the slurry.

7. The method of claim 1, further comprising using a control system to adjust the injection pressure, an injection flow rate, an injection volume, an injection location, or a deposition rate of the slurry based on real time data from the surface indicators.

8. The method of claim 1, wherein the lifting routine includes periodically pausing the injection of the slurry and assessing the rise in elevation via the surface indicators.

9. The method of claim 1, further comprising: performing a second lifting routine after an initial settlement of the surface area.

10. The method of claim 9, wherein a second target subterranean depth/stratum is selected.

11. The method of claim 1, further comprising detecting the deformation of the surface in real time using the surface indicators.

12. The method of claim 1, further comprising calculating the injection material's volume required to achieve the target lift elevation based on the detected position of the directional drill and geological data.

13. The method of claim 1, further comprising sealing the wellbore upon completion of the injection process to prevent contamination of surrounding strata.

14. The method of claim 1, wherein a target lift comprises a raise of elevation of more than six inches.

15. The method of claim 6, wherein the suspended solid particles of the slurry form a new stratum in or adjacent to the target subterranean depth/stratum.

16. The method of claim 1, wherein the slurry is selected for uplift and stability and comprises fine material selected from the group consisting of gypsum, clay, and combinations thereof.

17. The method of claim 1, wherein the injection material is deposited at a pressure and flow rate determined based on the geological characteristics of the stratum and the desired lift elevation.

18. The method of claim 1, wherein the surface indicators comprise at least one of global positioning system (GPS) data, laser distance measurements, or tilt sensors positioned at a plurality of locations across the surface area.

19. The method of claim 7, further comprising generating, by the control system, a predictive model of surface uplift based on the real time data from the surface indicators and adjusting the deposition rate of the slurry based on the predictive model.

20. The method of claim 1, wherein the surface area comprises a flood prone surface area extending across a plurality of existing surface structures, and wherein the target lift elevation is selected to reduce flood risk to the flood prone surface area.

* * * * *